US008074385B2

(12) United States Patent
Wagner

(10) Patent No.: US 8,074,385 B2
(45) Date of Patent: Dec. 13, 2011

(54) ONE-PIECE PHOTOGRAPH DISPLAY ASSEMBLY AND METHODS OF USE

(75) Inventor: Paul A. Wagner, Cypress, TX (US)

(73) Assignee: Cole & Ashcroft L.P., Houston, TX (US)

( * ) Notice: Subject to any disclaimer, the term of this patent is extended or adjusted under 35 U.S.C. 154(b) by 0 days.

(21) Appl. No.: 12/911,953

(22) Filed: Oct. 26, 2010

(65) Prior Publication Data

US 2011/0088302 A1 Apr. 21, 2011

Related U.S. Application Data

(63) Continuation of application No. 11/673,574, filed on Feb. 10, 2007, now Pat. No. 7,818,904.

(60) Provisional application No. 60/772,072, filed on Feb. 10, 2006.

(51) Int. Cl.
*G09F 1/00* (2006.01)

(52) U.S. Cl. ..... 40/124.18; 40/750; 40/751; 40/748; 40/753; 40/754

(58) Field of Classification Search ..... 40/124.16, 40/124.17, 124.18, 750, 751, 748, 753, 754; 248/459, 464

See application file for complete search history.

(56) References Cited

U.S. PATENT DOCUMENTS 2,380,076 A * 7/1945 Scheyer ..... 40/753
3,242,603 A * 3/1966 Righenzi ..... 40/124.17
3,355,828 A * 12/1967 Betz ..... 40/750
3,545,115 A * 12/1970 Nichols ..... 40/750
3,713,238 A 1/1973 Hyman et al.
3,875,693 A 4/1975 Pelkey
4,001,958 A * 1/1977 Fecko ..... 40/124.06
4,014,120 A 3/1977 Merz
4,149,800 A 4/1979 Secreto
4,167,241 A 9/1979 Zumbrunn
4,199,126 A 4/1980 Komendowski
4,622,769 A 11/1986 Friedman
4,681,253 A 7/1987 Engelhardt
4,750,283 A 6/1988 Halpern
4,777,746 A 10/1988 Brooks
4,819,354 A 4/1989 Papov
4,890,402 A 1/1990 Carroll
5,303,489 A 4/1994 Blegen
5,337,949 A 8/1994 Seeley
5,351,425 A * 10/1994 Knappe et al. ..... 40/751
5,359,794 A 11/1994 Wood
5,361,521 A * 11/1994 Burtch ..... 40/750
5,570,526 A 11/1996 Wallon (Continued)

*Primary Examiner* — Gary Hoge
(74) *Attorney, Agent, or Firm* — Locke Lord LLP

(57) ABSTRACT

A light-weight display easel assembly for use with photographs and photographic greeting cards is described, wherein the display device is a substantially planar sheet or panel of paperboard or similar cellulose-containing material having a plurality of die-cut flaps thereon, each of the die-cut flaps having one scored edge which allows for the outward folding of the flap. The display easel further comprises a plurality of adhesive strips on the front face of the paperboard, for attachment of a photograph or photographic greeting card thereto. The display easel, once assembled, is lightweight enough such that it can be mailed without the need for excess postage fees. Additionally, due to the attachment of the display easel to substantially the entire back face of a photograph, the entire photograph is fully supported and is therefore resistant to creases, indentations, warping, and other damages which can occur during the mailing process.

11 Claims, 8 Drawing Sheets

U.S. PATENT DOCUMENTS

| | | | | |
|---|---|---|---|---|
| 5,619,816 | A | 4/1997 | Ellison | |
| 5,622,384 | A | 4/1997 | Bradley | |
| 5,740,957 | A | 4/1998 | Wenkman | |
| 5,950,341 | A * | 9/1999 | Cross | 40/750 |
| 6,179,119 | B1 * | 1/2001 | Manoogian | 206/308.1 |
| 6,378,233 | B1 | 4/2002 | Haines-Woon | |
| 6,382,581 | B1 | 5/2002 | Duff | |
| 6,427,371 | B2 | 8/2002 | Olson et al. | |
| 6,460,280 | B1 | 10/2002 | Haines-Woon | |
| 6,584,717 | B2 | 7/2003 | Cinquina | |
| 6,612,061 | B2 | 9/2003 | Janetzke | |
| 6,694,657 | B2 | 2/2004 | Tsao | |
| 6,832,445 | B2 | 12/2004 | Pitzen | |
| 6,871,430 | B1 | 3/2005 | Landolt | |
| 2002/0129530 | A1 | 9/2002 | Delozada et al. | |
| 2003/0012915 | A1 * | 1/2003 | Skinner | 428/43 |
| 2005/0091898 | A1 * | 5/2005 | Hori et al. | 40/754 |
| 2005/0193604 | A1 * | 9/2005 | Fein | 40/124.17 |
| 2005/0268511 | A1 * | 12/2005 | Dahlquist | 40/754 |

* cited by examiner

ONE-PIECE PHOTOGRAPH DISPLAY ASSEMBLY AND METHODS OF USE

CROSS REFERENCE TO RELATED APPLICATIONS

The present application is a continuation of U.S. patent application Ser. No. 11/673,574 filed on Feb. 10, 2007, now U.S. Pat. No. 7,818,904, which in turn claims benefit of and priority to U.S. Provisional Patent Application Ser. No. 60/772,072, filed Feb. 10, 2006, the contents of all of which are incorporated herein by reference in their entirety.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

This disclosure relates generally to display devices and easels for displaying photographs and pictures, and more particularly to an improved photograph display device. In particular, a photograph display device having a plurality of display orientation options is described.

2. Description of the Related Art

Displays and frames for photographs have been around for a considerable period of time, but with the increased use of digital photography, photographs that can be printed by the user at home, and a rise in the use of photographic greeting cards (photographs with a message or greeting printed directly on or around the photograph), the demand for means by which to display such images in a stable manner that is quick, easy, and economical has risen. Additionally, as the number of photographs, photographic greetings cards, and the like having pre-printed borders or greetings on their face increases in popularity, the need for a display device which doesn't block or encumber the view of the entire card while having the capability to be oriented in a number of display positions has increased.

Examples of lightweight, paperboard frames and displays for the exhibition of photographs, pictures, and similar graphic images attempting to address at least some of these industry needs are replete in the patent literature. For example, in U.S. Pat. No. 5,950,341 to Cross, a one-piece paperboard picture frame is described, having die cut flaps which fold into slots to hold the photograph to be mounted in a rectangular opening. The cooperative interconnection of the frame flaps and slots space the front panel from the next adjacent panel, and in doing so create a depth and "3-dimensional" quality to the frame at the display opening in which a photograph is to be mounted. U.S. Pat. No. 6,427,371 describes picture frames that are constructed from a single, flat die-cut foldable paperboard blank that is convertible into a three-dimensional picture frame without the use of adhesives or other fastening materials. Other examples of similar foldable displays include origami-style foldable picture frames, three-dimensional frame structures, collapsible die-cut picture frames, and prepackaged picture mounts for standard photographic pictures.

Examples also exist for photo display easels and self mailers combined into a single design. For example, U.S. Pat. No. 6,694,657 to Tsao describes a photograph picture frame that includes a picture holder for mounting a picture or photograph on the holder wherein the picture is slidably inserted into a recess in the frame. The holder is described to be capable of being folded a first way to form a display for the picture, and upon a second forward folding it becomes a "postal card" suitable for postal mailing.

While often creative, many of the previous display devices were not efficiently designed, were not easy to assemble or use, did not provide a securely displayed product, and/or were not economical to manufacture or provide. Additionally, numerous of the display devices which were suitable for use as a "postal card" ready for mailing were excessively bulky and required excess postage fees due to weight considerations. Thus, there exists a need for simple, easy-to-use display easels for use with photographs and photographic greeting cards that are lightweight and can be quickly and readily oriented to a variety of display positions. There also exists a need for a simple and easy-to-use display easel which will substantially reduce or eliminate unwanted photograph curl after attachment of the photograph to a display face of the easel, and that can simultaneously provide support so as to resist creases and other damages which may occur when such mounted photographs are transmitted using a postal service.

BRIEF SUMMARY OF THE INVENTION

The present disclosure provides a display device which responds to and satisfies the needs outlined above. In a first embodiment of the present disclosure, a display assembly for photographs and photograph-containing media is described, wherein the display assembly comprises a substantially flat sheet of cellulose-containing material, such as paperboard and lightweight cardboard cardstock, having a front face and an opposite back face; a plurality of foldable flaps die-cut into the sheet and having two or more edges, a selected edge of each of the foldable flaps being scored instead of die-cut; and at least one strip of adhesive material having a first face applied to the front face of the sheet and a second outer face opposite the first face, wherein the at least one adhesive strip does not overlap the plurality of foldable flaps. The at least one adhesive strip along a portion of the front face of the flat sheet is suitable for adhering a graphic material such as a photographic greeting card or a printed photograph to the front face of the assembly.

In another aspect of the present disclosure, a display device for a standard size photograph or photographic display is described. The display device comprises a generally rectangular, substantially flat planar back plate having a front face and an opposite back face, wherein the flat back plate has a plurality of foldable flaps die-cut into the sheet, one edge of each of which being scored in a perforated manner instead of die-cut for ease of folding. The flat back plate also has a plurality of adhesive strips along the front face of the sheet, each of which is covered with a protective film.

In another aspect of the present disclosure, an article to be displayed on a surface is described, the article comprising an easel having front and back major surfaces; a plurality of adhesive strips adhered to the front major surface; a graphic display member arranged and attached adjacent to the front major surface of the easel; and a functional member extending outwardly from the back surface of the easel, wherein the graphic display member is attached to the front major surface of the easel by the adhesive strips, and wherein the functional member serves to support the easel and the graphic display member.

In a further aspect of the present disclosure, a display means for displaying a photograph or photograph-comprising item is described, the display means comprising a substantially flat display means having a front face and an opposite back face; a plurality of support means die-cut into the display means, wherein a selected edge of each of the support means is scored for the purpose of folding; and at least one adhesive means applied to the front face of the display means, wherein the at least one adhesive means is located between, around, or both between and around the plurality of support means.

In yet another aspect of the present disclosure, a method of using a display assembly as detailed herein is described, wherein such method comprises obtaining a photograph-containing article that is in the form of a substantially flat sheet panel, having opposite front and back sides, the article having a graphic image on the front side and being substantially plain on the back side; folding at least one of the plurality of foldable flaps of the display assembly along the scored edge in a direction away from the front face of the display assembly; and, adhesively bonding together the back side of the article and the front face of the display assembly using the adhesive material. This method may optionally further comprise punching at least one of the foldable flaps of the display assembly through the flat panel sheet in order to remove the flap from the panel, and/or removing a release liner from an outer surface of the adhesive material prior to the adhesive bonding step.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1:
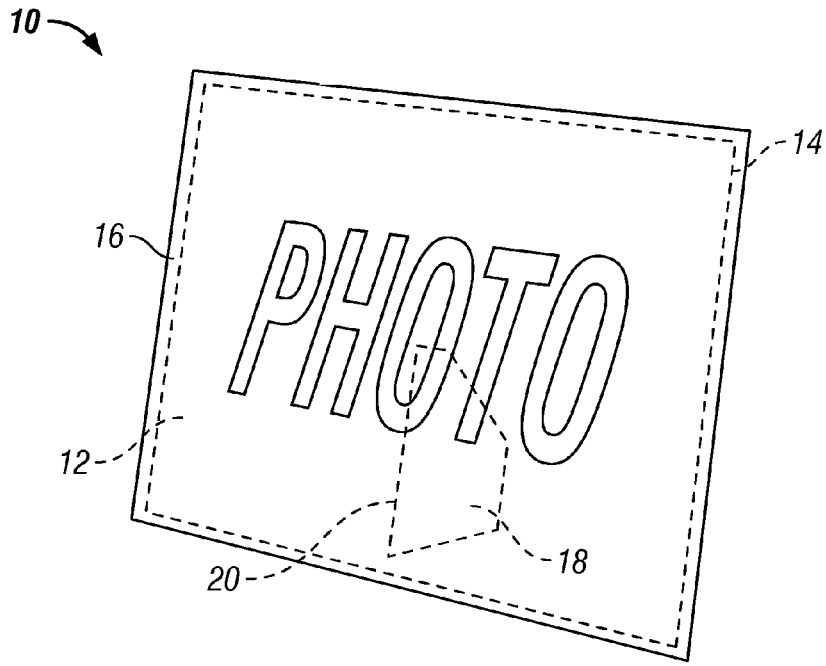
FIG. 1 illustrates a front perspective view of a display easel in accordance with an embodiment of the present invention, having a photograph mounted thereto.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

One or more illustrative embodiments incorporating the invention disclosed herein are presented below. Not all features of an actual implementation are described or shown in this application for the sake of clarity. It is understood that in the development of an actual embodiment incorporating the present invention, numerous implementation-specific decisions must be made to achieve the developer's goals, such as compliance with system-related, business-related, government-related and other constraints, which vary by implementation and from time to time. While a developer's efforts might be complex and time-consuming, such efforts would be, nevertheless, a routine undertaking for those of ordinary skill the art having benefit of this disclosure.

In general terms, applicant has created a lightweight display easel assembly for mounting and displaying photographs, photographic greeting cards, photographic announcements, and the like in a plurality of orientations, wherein the display easel is a one-piece sheet of cellulose-containing material, such as paper stock, paperboard or lightweight card stock, the cellulose-containing material having a plurality of flaps die-cut onto the stock, and one or more adhesive strips applied to a front face of the display easel. The adhesive strips typically have protective labels or films attached to their outward face, to prevent adhesion until the object to be mounted is applied. In a mounting method typical in association with the display easels of the present invention, one or more die-cut flaps are folded outwardly from the back side of the display easel using a score line, thereby forming the desired orientation in which the image is to be displayed. The labels on the adhesive strips are removed, and a photographic greeting card (or other suitable photographic image) is mounted onto the front face of the display easel by adhesively bonding the back face of the item to be mounted to the outwardly-facing adhesive strips on the front face of the easel. Such a lightweight display can be easily displayed, or mailed without the need for postage outside standard first-class postage rates (e.g., 1 ounce).

Turning now to the figures, FIG. 1 illustrates a front perspective view of a display easel 10 in association with an aspect of the present invention, with a photograph 16 mounted to its front face, thereby forming a display assembly. Display easel 10, which is equivalently referred to as display assembly 10 herein regardless of whether it is illustrated in association with mounted media or not, is generally a rectangular (or square) shaped, substantially planar and flat sheet of cellulose-containing material, such as a paperboard material, having opposite front and back faces, 12 and 14, respectively. The display easel 10 also comprises a plurality of die-cut support flaps 18, which are capable of being folded outwardly along a score line 20 in a manner such that flaps 18 extend outwardly away from front face 12. While in the figures throughout this disclosure the score lines 20 are illustrated to be perforated score lines, this is for purposes of clarity and is not intended to be limiting. For example, score line 20 may be a line comprising a preformed indentation or non-penetrating score, so as to facilitate the outward folding of the support flaps 18. The plurality of support flaps allows for the photograph, photo greeting card, or other graphic display to be oriented in a plurality of directions, dependant only upon the choice of the user and/or the orientation of the photograph or other graphic display member being attached to the display easel. Further, as a result of this advantageous plurality of variously-oriented support flaps, no care needs to be taken by the user to orient the photograph in a "proper direction". Regardless of which orientation the photograph or other graphic display member is attached to the front face of the display device, the user need only fold out the appropriate support flap in order to achieve the desired orientation of the completed assembly.

Display device 10 can be formed of any cellulose-containing or cellulose-derived material, such as a relatively rigid paperboard material, including but not limited to Kraft paper, lightweight cardboard, cardstock, coated papers or paperboards, colored paperboard, fiber-based papers, archival paper, rag paper, recycled paper, bond paper, combinations thereof, and the like. As used herein, the term "Kraft paper" refers to paper products produced using the Kraft process (also known as Kraft pulping or the sulfate process, as described, for example, in US EPA publication No. EPA-450/3-83-017), which typically involves the use of caustic sodium hydroxide and sodium sulfide to extract the lignin from wood chips in large pressure vessels or digesters in a batch or continuous manner (e.g., using a Kamyr digester). In accordance with one aspect of the present disclosure, the cellulose-containing material is a relatively rigid paperboard material, selected from the group consisting of lightweight cardboard, cardstock, paperboard, fiber-based paper, and recycled paper and paperboard products. In accordance with aspects of the present disclosure, the term paperboard refers to those paper products of which the surface has been treated with clay or some other pigment and adhesive mixture, or other suitable material, to improve the finish with respect to printing quality, color, smoothness, opacity or other surface properties. The term may also be equivalently applied to lacquered and varnished papers. Preferably, the cellulose-containing material, such as paper or paperboard material, used in accordance with the present disclosure is substantially acid-free, substantially lignin-free, or both.

As used herein, the term "substantially acid-free" refers to a cellulose-containing material, such as a paper or paperboard product, having substantially no free acid present, and therefore having a substantially neutral (pH 6-7) or substantially basic pH (pH 7.0 or greater) value. This term also refers to those papers products and paperboard products that have been treated with a mild base during their production, (such as bicarbonates like calcium or magnesium bicarbonate) in order to neutralize the natural acids occurring in wood pulp. Such substantially acid-free paper may also be buffered with suitable materials in order to prevent the formation of additional acids. Substantially acid-free cellulose-containing materials, such as paper or paperboard materials, are desirable for use herein because such products won't ruin photographs or cause paper fibers to disintegrate, become brittle, crack, or discolor. Such preferred papers or paperboards may also referred to as being alkaline (having a pH of more than 7.0).

Similarly, the term "substantially lignin-free", as used in the present specification and claims, refers to those cellulose-containing materials, such as paper or paperboard products, wherein the amount of lignin is less than or equal to about 10% by weight of the total solids in the pulp or paper, preferably less than or equal to about 5% by weight (wt. %), and even more preferably less than or equal to about 1 wt. % lignin, and preferably less than about 1 wt. % lignin. The term "lignin", as used herein, refers to the substance that gives plants and trees their strength and rigidity, binds wood fibers together, and fills the spaces in the plant or tree cell wall between cellulose, hemicellulose, and pectin components; paper that contains large amounts of lignin, such as newsprint, is very acidic and will turn yellow when exposed to light and humidity.

Figure 2:
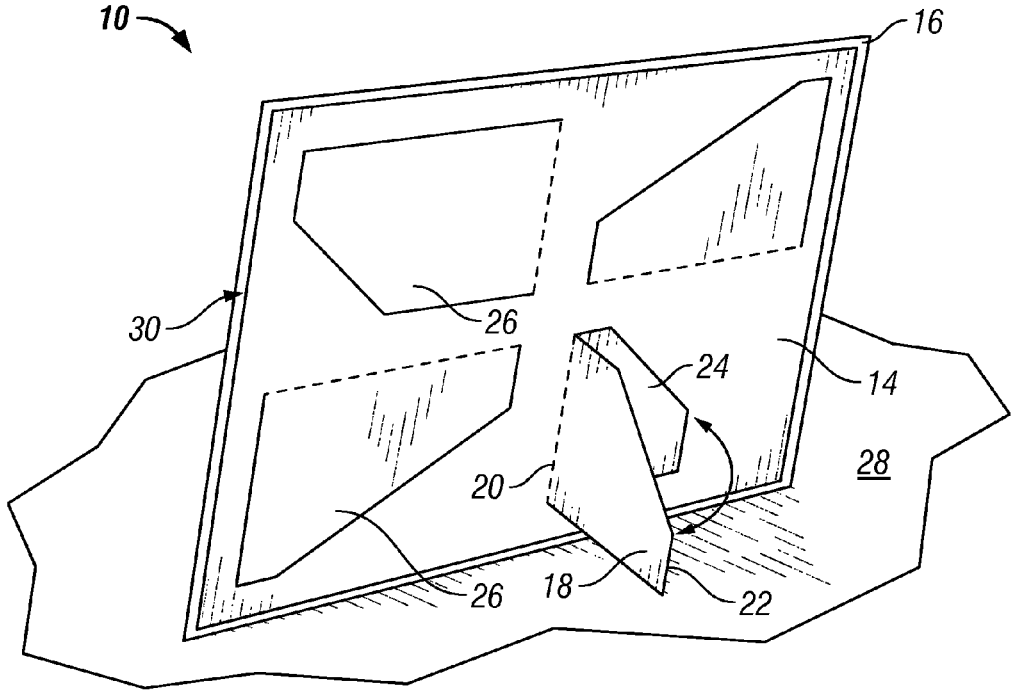
FIG. 2 illustrates a perspective view of the back side of the display easel illustrated in FIG. 1.

FIG. 2 illustrates the exemplary display easel 10 of FIG. 1 from a rear perspective. In this view, the back face 14 of the main, substantially flat, planar body sheet 30 of easel 10 is more clearly depicted, with support flap 18 being folded away from front face 12 along perforated score line 20 so as to provide a support against a display surface 28, such as a table, counter, or a fireplace mantel. In the non-limiting aspect shown in FIG. 2, while the display easel 10 has a plurality of support flaps 26 die-cut into it, only one support flap 18 has been folded out and extended outwardly away from the back face 14 of the display device, thereby forming a support member. In folding support flap outwardly along perforated score line 20, flap void 24 is formed. While it is envisioned that support flaps 26/18 can be of any general shape, in one, non-limiting aspect of the present invention, extended support flap 18 (and non-extended flaps 26) can have a back edge 22 which is substantially parallel to the perforated score line 20. In further, optional aspects of the present disclosure, support flaps 26 may comprise a score line 20 and a generally curved, semi-circular edge, such that the support flaps have or comprise an arcuate shape.

As is also illustrated in FIG. 2, photograph 16 which is adhered to the front face 12 of the display device of the present disclosure, need not fit exactly to the edges of easel 10 in order for the device to operate correctly, but can also extend past the edges of 10, as shown. In this sense, the dimensions of the display device/easel 10 can be generally rectangular or square, of any size. For example, easel 10 can be manufactured to be the size of, or slightly less than, the dimensions of standard photographs, including but not limited to 3×5 photographs, 4×6 photographs, 4×8 photographs, 5×7 photographs, 5×8 photographs, 8×10 photographs, and variations thereof. Preferably, in accordance with one aspect of the present disclosure, the display device/easel of the present invention will have a first set of parallel sides and a second set of parallel sides, wherein the first set of parallel sides is longer than the second set of parallel sides. Further examples of dimensions suitable for the display devices/easels of the present disclosure include but are not limited to 3⅞"×7⅞", 3⅞"×5⅞", 2⅞"×4⅞", 4⅞"×6⅞", and 7⅞"×9⅞".

Figure 3:
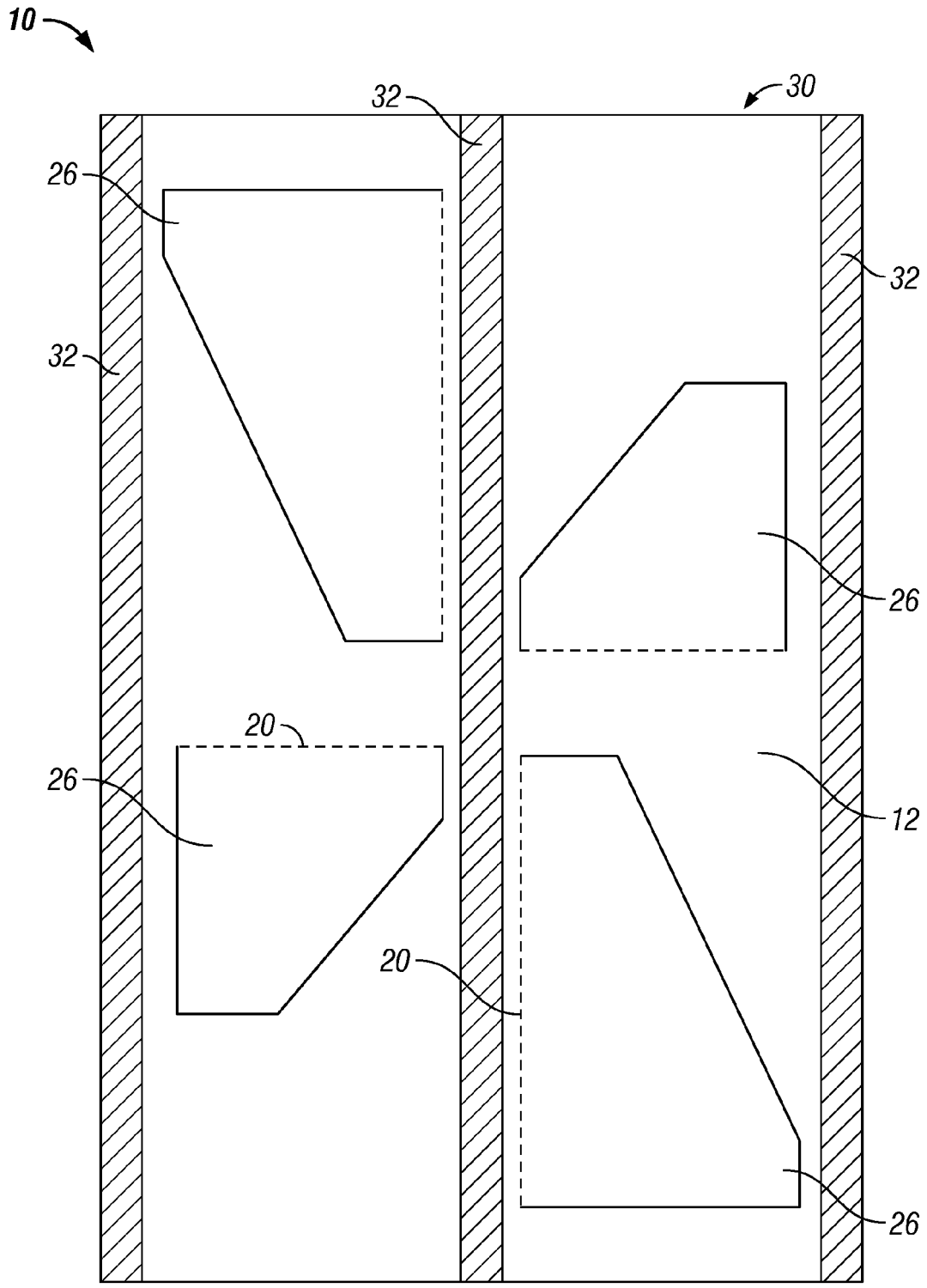
FIG. 3 illustrates a plan view of the front side of the display easel illustrated in FIGS. 1 and 2 in the initial form of a flat sheet which can be folded to produce the display easel.

FIG. 3 illustrates a top, frontal view of an arrangement of die-cut flaps 26 on a planar sheet 30, similar to display device 10 illustrated in FIGS. 1 and 2, prior to use as a support and display means. As illustrated therein, the front face 12 of easel 10 also comprises a plurality of adhesive strips, 32. The number of adhesive strips comprising the plurality of adhesive strips 32 may range from at least two adhesive strips to ten adhesive strips, as well as numbers of adhesive strips inclusive within this range. Die-cut flaps 26 can be of any general shape, although preferably they are polygonal (closed figures made by joined line segments, where each line segment intersects exactly two others), including both regular polygons (a polygon whose sides are all the same length, and whose angles are all the same) and irregular (a polygon whose sides are of differing length and whose angles are not all the same, such as an irregularly-shaped five-sided polygon, or a trapezoid). Each of the die-cut foldable flaps 26 are joined to the body of planar sheet 30 along a scored line 20, which may be optionally perforated, as shown by the dashed lines. As discussed in greater detail below, the flaps are adapted to be folded outwardly away from the back face 14 of the display device, along the scored line 20 of the panel.

Figure 4:
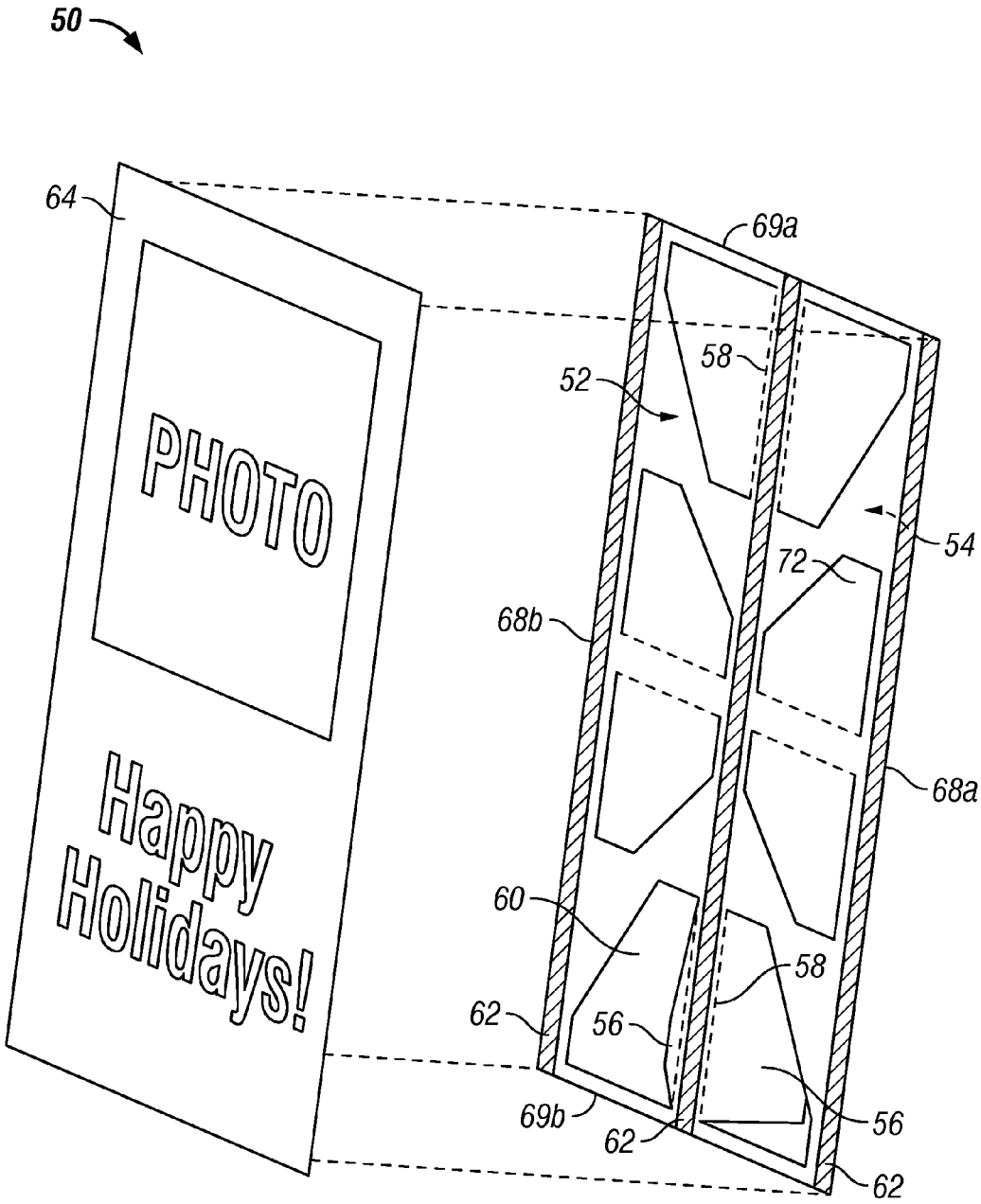
FIG. 4 illustrates a front perspective view of the front side of a display easel in accordance with an embodiment of the present invention, illustrating the mounting of a photograph thereto.

In FIG. 4, an aspect of the present invention is illustrated, wherein another suitable orientation of a display easel 50 is shown, having side edges 68*a* and 68*b* which are substantially parallel to each other, and top and bottom end edges 69*a* and 69*b*, which are also substantially parallel to each other. As seen in FIG. 4, side edges 68*a* and 68*b* are longer than end edges 69*a* and 69*b*. Display device 50 also has a first major front surface 52 and a second, back surface 54, the latter of which is illustrated more clearly in FIG. 5, discussed below. Display easel 50 as shown is comprised of a plurality of un-punched, die-cut flaps 72, and two outwardly-folded support members 56, which are die-cut flaps folded outwardly away from the front surface 52 along perforated score line 58. In practice, photographic greeting card 64 may be attached to the front face 52 of display device 50 by way of a suitable attachment means, illustrated as a plurality of adhesive strips 62.

Figure 5:
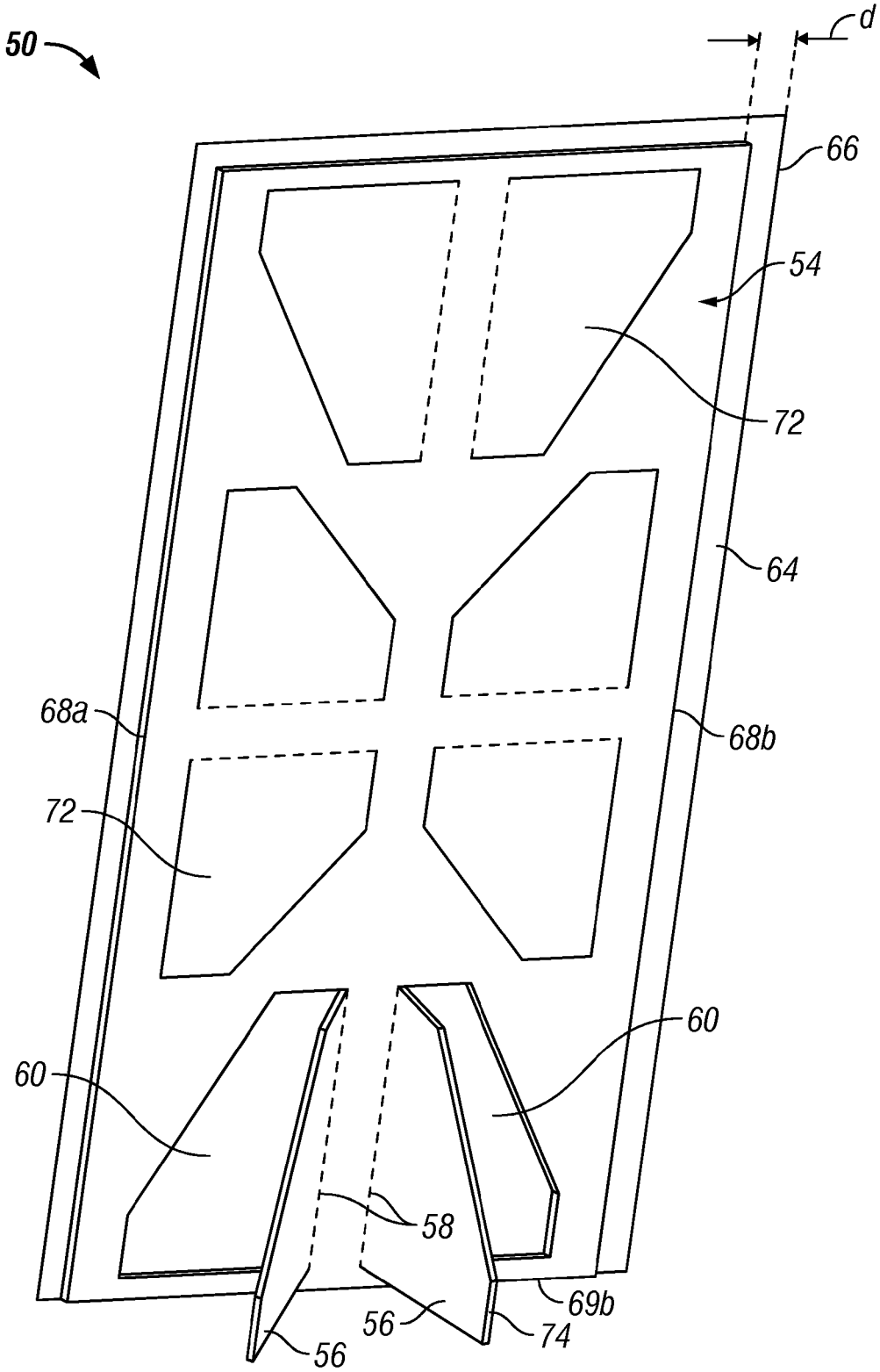
FIG. 5 illustrates a rear perspective view of the display easel of FIG. 4, with the photograph mounted to the front face of the easel.

FIG. 5 illustrates a back perspective view of the display device/easel of FIG. 4, with photographic greeting card 64 mounted to the front face 52. While it is illustrated in the figure that edges 66 of photograph greeting card 64 extend slightly beyond the edges 68*a*, 68*b* of easel 50 a distance d, this is by no means meant to be a requirement. As suggested previously, in some instances photographic greeting card 64 can have a size substantially identical to the size of easel 50.

As is more clearly seen in FIG. 5, while easel 50 has a plurality of foldout support members 72, only the flaps 56 are punched out to support the easel in the desired display orientation. Support members 72 typically remain un-extended, until the orientation of the easel itself is changed, e.g., the display is rotated 90 degrees. As is further shown in FIG. 5, when flaps 56 are extended outwardly away from back edge 54, they create punch-out voids 60. Additionally, and in an alternative yet equally acceptable embodiment of the present invention, flaps 56 can be of such an irregular or regular polygonal shape so that they comprise a back edge 74 which is substantially perpendicular to score line 58.

Figure 6:
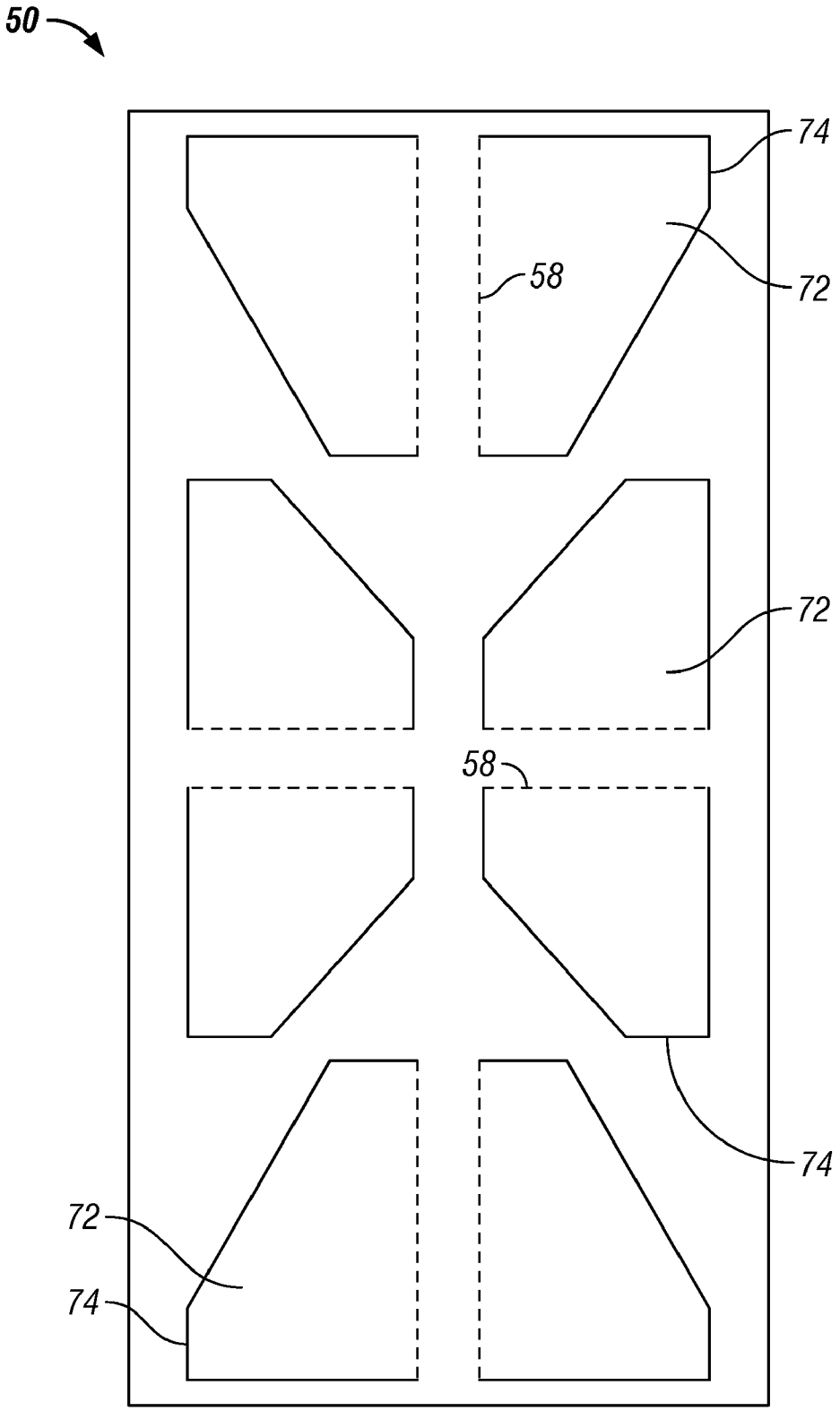
FIG. 6 illustrates a plan view of the front side of the display easel illustrated in FIGS. 4 and 5 in the initial form of a flat sheet which can be folded to produce the display easel.
Figure 7A:
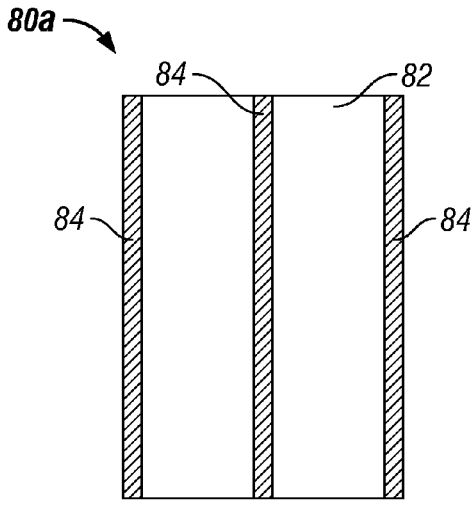
FIGS. 7A-D illustrate plan views of the front side of a picture frame in accordance with the present invention, showing optional placements of adhesive strips in accordance with the present invention.
Figure 7B:
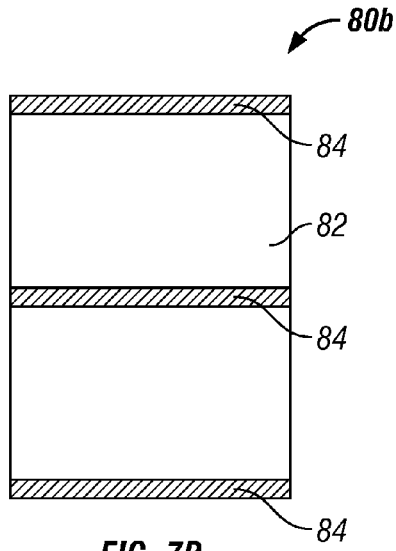
Figure 7C:
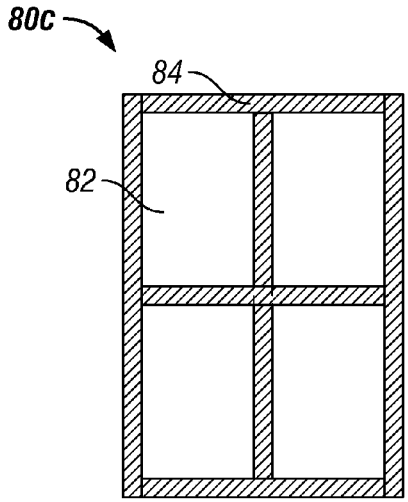
Figure 7D:
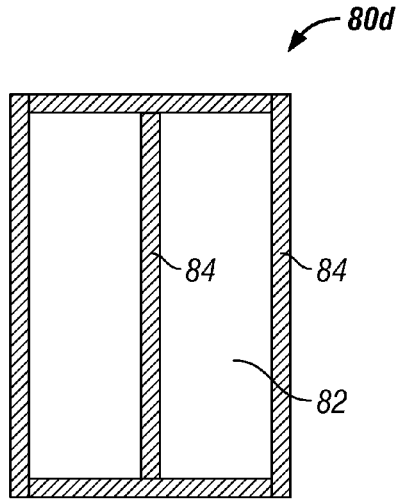

FIG. 6 illustrates a plan view of the display device/easel 50 of FIGS. 4 and 5, without the photographic greeting card 64 attached, illustrating a further optional design orientation of the plurality of un-punched support members 72, prior to the folding steps of use, each of which has one edge which is a (perforated) score line 58. As also illustrated therein, but in no way meaning to be limiting, the support members 72 can have a back edge 74 that will extend away from the back face of the easel 50, and which is substantially parallel to the score line 58 of the individual support member 72.

Adhesive strips 62 can be any of a number of conventionally known adhesives, including stretch-releasing adhesives, double-sided adhesive tape, hot melt (thermoplastic) adhesives, pressure-sensitive adhesives (PSA), and acid-free adhesives, as well as combinations thereof, such as acid-free pressure-sensitive adhesives and hot-melt (thermoplastic) pressure-sensitive adhesives. In an aspect of the present disclosure, and similar to the material on which they are adhered, the adhesive stips are preferably acid- and/or lignin-free, so as to minimize or prevent the premature deterioration ion of photographs and similar graphic materials mounted onto the display panel. Preferably, in accordance with one aspect of the present disclosure, the adhesives are hot melt adhesives or pressure-sensitive adhesives having a MI (melt index) ranging from about 250 grams/10 minutes to>1,000 grams/10 minutes and/or a flatwise tensile strength of 5 psi or greater, and/or, application temperatures ranging from about 10° C. to about 450° C., including application temperature ranges within this range, such as from about 20° C. to about 100° C., from about 100° C. to about 150° C., from about 150° C. to about 200° C., from about 200° C. to about 230° C., and from about 325° C. to about 400° C. In accordance with further, equally acceptable but non-limiting aspects of the present disclosure, the adhesives used in forming the adhesive strips on the front face of the easel assemblies detailed herein may be any of a number of known thermoplastic adhesives having a glass transition temperature ($T_g$) ranging from about −40° C. to about 300° C., including about 25° C., about 45° C., about 85° C., about 145° C., about 180° C., and about 280° C., as well as $T_g$ values within this range of glass transition temperatures. Non-limiting examples of suitable adhesives for use with the display devices of the present invention are the AROMELT® and AROMELT FUTRUA® Adhesives (Ashland Specialty Chemicals, Dublin, Ohio), a hot-melt (thermoplastic) pressure-sensitive urethane adhesive. Typical hot melt adhesives (HMAs) or pressure-sensitive adhesives (PSAs) suitable for use with the display easel of the present invention may be water-based or not, and include but are not limited to adhesives comprising ethylene vinyl acetate (EVA) copolymers, those comprising styrene-isoprene-styrene (SIS) copolymers, those comprising styrene-butadiene-styrene (SBS) copolymers, those comprising ethylene ethyl acrylate copolymers (EEA), those comprising polyurethane reactive (PUR) polymers or copolymers, adhesives comprising block copolymers, adhesives comprising hydrogenated hydrocarbon resin, adhesives comprising a hydrocarbon resins (including aromatic resins, aliphatic resins, blended resins, polyterpene resins, alpha-methylstyrene resins, and vinyl toluene resins), adhesives comprising a hydrocarbon oil, waxes (natural and synthetic), paraffins, rosin, urethane adhesives, butyl adhesives such as MELTRON HB™ (Diabond Industry Co., Lt.) or HAMATIGHT HOTMELT M-120™ (Yokohama Rubber Co., Ltd., Japan), and combinations of two or more of these adhesives.

The adhesives useful in combination with the display easels of the present invention can further comprise one or more optional ingredients, including but not limited to oils, plasticizers, thickeners, thermoplastic polymers (to adjust hardness, cohesive strength, and other physical characteristics), stabilizers, antioxidants, and the like. Other compounds can be added to effect color, opacity, hardness, weight (after cooling, and tack, including fillers, pigments, dyes, and perfumes. Further optional additives can also be included which make the adhesive substantially acid-free, substantially lignin-free, or both.

Figure 8:
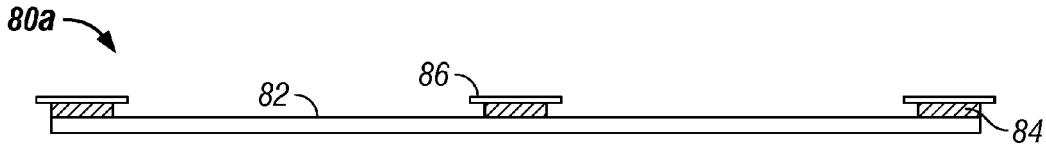
FIG. 8 illustrates a side view of a display easel of the present invention.

The figures above have illustrated that the display devices/easels of the present disclosure comprise a plurality of adhesive strips by which the photograph, photo greeting card, or other pictorial material is mounted to the front face of the display device. It is to be understood that there is no requirement for the number of adhesive strips used in accordance with the present disclosure, although it is generally believed to be disadvantageous to use only one adhesive strip, due to the unwanted curl and picture deformity which can result from using only one strip. Additionally, in accordance with the present disclosure, there should be preferably be no adhesive or adhesive strip(s) where the support flap is. Accordingly, the plurality of adhesive strips as used herein can mean, without limitation, two, three, four, five, six, seven, eight, nine, or ten adhesive strips, as well as numbers of adhesive strips greater than 10 if appropriate. Examples of various orientations and layouts of adhesive strips 84 for use in association with the front face 82 of display devices/easels 80*a*, 80*b*, 80*c* and 80*d* are illustrated in FIGS. 7A-7D. As illustrated in FIG. 8, a side view of the display device 80*a* is shown. As is evident therein, adhesive strips 84 can be spread along the front face 82 of easel 80*a* in a substantially parallel manner. Adhesive strips 84 further comprise an adhesive release liner 86 which covers the outer surface of the adhesive strip, but which is removed just prior to mounting of the photographic greeting card, etc., thereby exposing the adhesive side of the strip 84.

The adhesive release liner 86 used in combination with the adhesives useful in combination with the display easels of the present disclosure can be any of the known adhesive cover films known in the art, the selection of which will vary with the choice of adhesive. The most common cover films used in combinations with the adhesives used herein can comprise paper, foil, or thermoplastic stock. Thermoplastic materials that can be used as cover films 86 in the present invention include but are not limited to polyethylene, polypropylene, polystyrene, foamed polystyrene, expanded polystyrene, polyvinyl chloride, natural products including rayon or cellophane, film-type labels such as those based on cellophane or polyolefin materials, and the like. In accordance with the present disclosure, the adhesive release liner 86 can also be a silicone-coated liner.

Figure 9A:
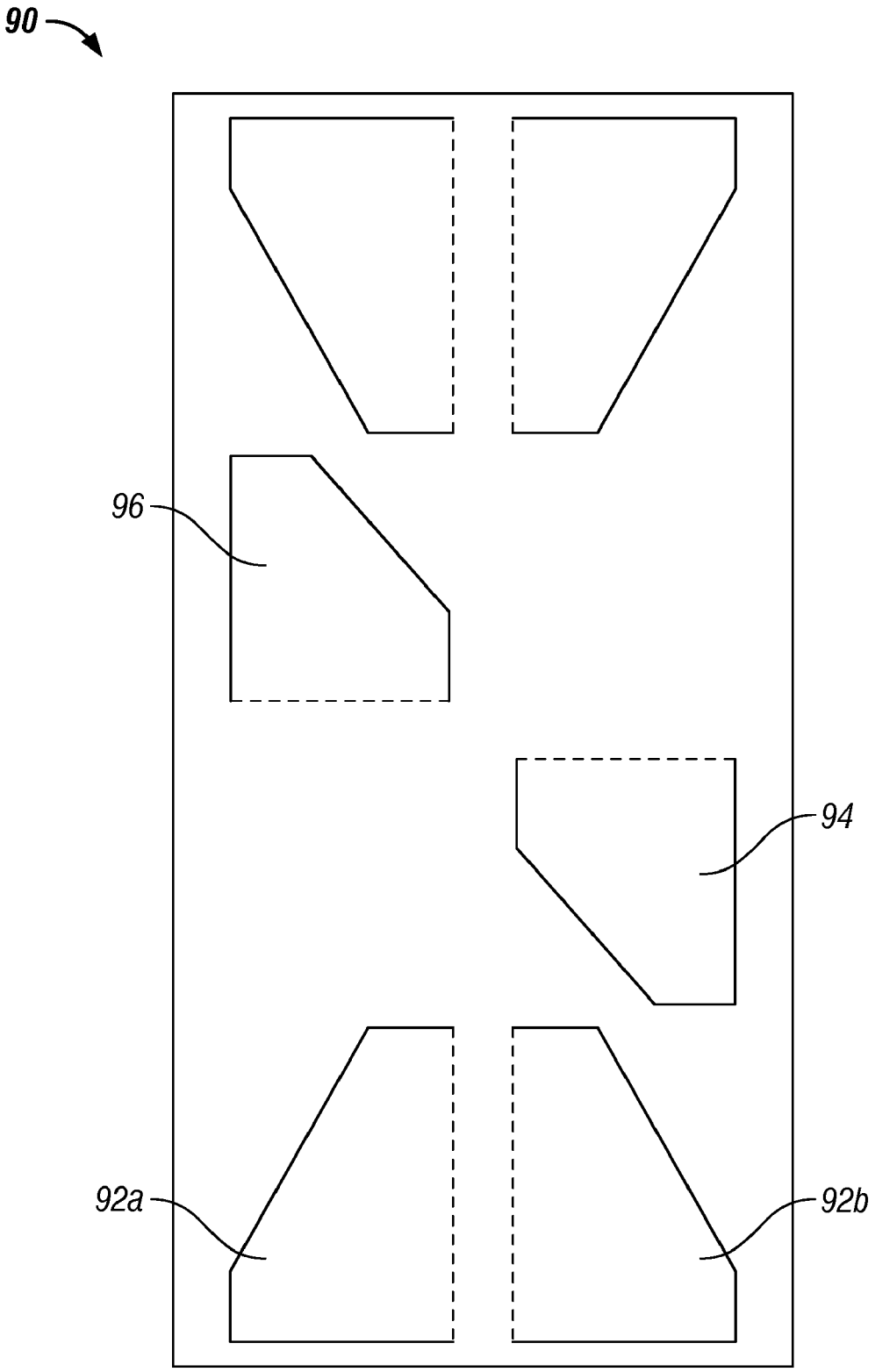
FIGS. 9A-B illustrate further optional arrangements of the display easel in accordance with the present invention.
Figure 9B:
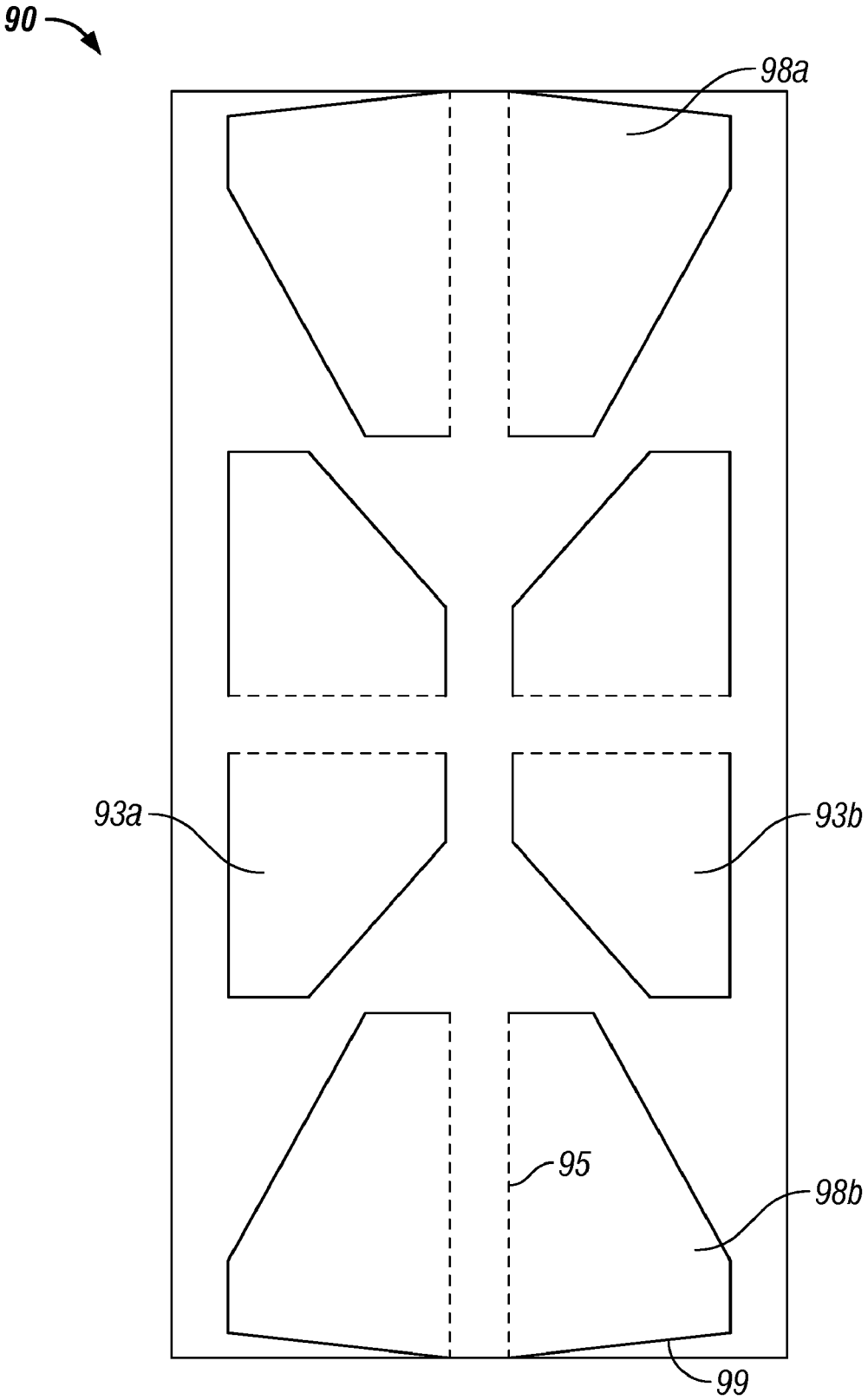

FIGS. 9A and 9B illustrate further design aspects of the display easels of the present invention, showing various, suitable orientations for the die-cut flaps. For example, in FIG. 9A, display device/easel 90 comprises two pairs of die-cut flaps 92*a* and 92*b* which are along the short edge of easel 90, for providing support when the easel is displayed in an upright position. The easel 90 can also comprise opposite, shorter individual flaps 94 and 96 for use in displaying the easel in the length-wise orientation. FIG. 9B illustrates an aspect of the present invention wherein the display device/easel 90 comprises four pairs of die-cut flaps 93*a*, 93*b*, 98*a* and 98*b*. As can be seen therein, flaps 98*a* and 98*b* can have angular support edges 99 which form a non-perpendicular angle with score line 95.

In addition to their use as a display easel for holiday photographic greeting cards, and photographs in general, the display easels of the present invention can also be used in combination with a number of photograph-based greetings or announcements, including but not limited to baby announcements, wedding announcements, and graduation announcements. Further, it is envisioned that in addition to being able to be readily mailed due to their lightweight characteristics, the articles to be displayed (the combination of the display easel and a photograph or image mounted to the front face thereof) as described herein can be easily stored in standard sized photograph albums. This is a result of the display easels being substantially the same size, or just a little smaller than, the standard sized photographs or photographic greeting cards to be displayed. A further utility of the display easels having photographs, photo greeting cards, or other graphic displays mounted thereto, as described herein, is in scrapbooks, where the displays can be readily used and/or mounted, and in related scrap-booking applications.

As indicated previously, the display easels of the present disclosure has several advantages and distinctions over previously described display assemblies. For example, one previously known assembly has only a single adhesive portion, which can result in unwanted curling of the attached photograph. Other assemblies are of such bulk, weight, or complexity of use that they may become unappealing to consumers. The present display assemblies are advantageously lightweight, such that they can be mailed, in combination with the mounted photograph or photo greeting card, often without the need for excess postage fees (depending, for example, upon the size of the photographic article and display assembly). Additionally, due to the attachment of the present display easel to substantially the entire back face of a photograph as described herein, the entire photograph is fully supported and is therefore resistant to creases, indentations, warping, and other damages which can occur during the mailing process. Further advantages of the presently described display easels are that, due to their construction and novel use of adhesives, unwanted and damaging curl of the photograph or similar graphic media adhered to the front face of the easel is substantially reduced or eliminated. Additionally, due to the support provided by the easel for the photographs and/or photo greeting cards and the like to be mounted, the photographs or photo greeting cards may be optionally printed on thinner paper stock without a detrimental loss of rigidity as they can be combined with the easels of the present disclosure to reclaim, and in some case enhance, the rigidity.

The display easels of the present disclosure can be manufactured using processes comprising the use of die-cutting/scoring machines known to in the art. The die-cutting/scoring machine scores each individual sheet to produce the perforated scoring lines 20, which provide the folding joints for the flaps. Simultaneously (or separately), the machines die-cut the cut lines 30 for the plurality of flaps 18, which define the edges and base of the flaps. Typically, the display easels can be manufactured by the sheet, with each sheet having two or more (e.g., three or four) display easels scored and die-cut simultaneously. For example, after the scored and die-cut sheet of FIG. 3 or FIG. 6 has been produced, the sheet can be transferred to a gluing machine which applies adhesive (such as a pressure-sensitive adhesive) in one or more strips to the front face of the easels, and then applies a release liner (or a plurality of release liners, as appropriate) over the adhesive strips to protect the adhesive until the time of intended use. Optionally, the one or more adhesive strips can be applied to the paperboard sheets first, followed by the application of a suitable release liner. The display easels can then be die-cut and scored as described above. In either case, following the application of the adhesive and release liner, and the die-cutting process, the easels are then separated into individual products, and the product is then packaged singly or in multiple packs, or in combination with a suitably sized mailing envelope. The display easels can then be stored and shipped in flat, sandwiched configurations.

As described above, and referring generally to FIG. 4, in actual use by the end user, the display easel may typically be taken by the user who manually selects and folds one (or more) flaps along the perforated score line, under and away from the front face of the display easel. The flaps selected to be folded out will depend upon the orientation of the graphic to be displayed. In this sense, the display easel of the present invention readily allows for the display of a graphic (such as a photographic greeting card) in a plurality of orientations, to be determined by the user. The user removes the protective adhesive cover film from the adhesive strips on the front face of the display easel, exposing the tacky surface of the adhesive strips. A photographic greeting card, such as a 4"×8" photographic holiday greeting card or a digital photograph printed by a user on a home computer, is then adhered to the front face of the display panel by centering the greeting card, then pressing the back face of the greeting card against the adhesive on the front face of the display easel.

All of the compositions, methods, and/or processes disclosed and claimed herein can be made and executed without undue experimentation in light of the present disclosure. While the compositions and methods of this invention have been described in terms of preferred embodiments, it will be apparent to those of skill in the art that variations may be applied to the compositions, methods and/or processes and in the steps or in the sequence of steps of the methods described herein without departing from the concept and scope of the invention. For example, it will be apparent that certain agents which are chemically related may be substituted for the agents described herein while the same or similar results would be achieved. All such similar substitutes and modifications apparent to those skilled in the art are deemed to be within the scope and concept of the invention.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to protect all such modifications and improvements to the full extent that such falls within the scope or range of equivalent of the following claims.

What is claimed is:

1. A display assembly for photographs and photograph-containing media articles, consisting of:

a single panel of a substantially flat sheet of cellulose-containing non-hinged, non-folded material having a front face and an opposite back face and a rectangular shape;

four foldable flaps die-cut into the panel and having two, three, four or five edges, a selected edge of each of the foldable flaps being scored instead of die-cut;

two, three or four strips of adhesive material having a first face applied to the front face of the sheet and a second outer face opposite the first face; and a release liner on the outer face of the adhesive strips, wherein the adhesive strips do not overlap the foldable flaps, wherein two of the eight foldable flaps are oriented substantially perpendicular to each other, such that the display assembly may be oriented in a plurality of orientations on a surface, the orientation dependent upon which of the flaps are folded outward from the panel towards the surface, and wherein a photograph or photograph-containing media article may be attached to the front face of the assembly by way of the at least one strip of adhesive material.

2. The display assembly of claim 1, wherein the foldable flaps are in the shape of an polygon having 3 edges.

3. The display assembly of claim 2, wherein the foldable flaps are in the shape of triangles.

4. The display assembly of claim 1, wherein the foldable flaps comprise a back edge which is substantially parallel to the scored edge.

5. The display assembly of claim 1, wherein the adhesive strips are thermoplastic pressure-sensitive adhesives.

6. The display assembly of claim 1, wherein the cellulose-containing material is greater than about 90% lignin-free and is also acid free.

7. The display assembly of claim 6, wherein the cellulose-containing material contains less than about 10 wt. percent lignins.

8. The display assembly of claim 1 wherein the cellulose-containing material is a rigid paperboard material.

9. The display assembly of claim 1, wherein the substantially flat sheet of material is a sheet of photographic paper in a size selected from 3 inches by 5 inches, 4 inches by 6 inches, 4 inches by 8 inches, 5 inches by 7 inches, 5 inches by 8 inches, and 8 inches by 10 inches.

10. A display assembly for photographs and photograph-containing media, the display assembly consisting of:

a single panel of substantially planar cellulose-containing non-hinged material, the panel having a front face and an opposite back face;

four foldable flaps die-cut into the panel and having two, three, or four distinct edges, a selected edge of each of the foldable flaps being scored instead of die-cut; and a sheet of an adhesive material having a first face applied to the front face of the panel and a second outer face opposite the first face, wherein the adhesive strip does not overlap the foldable flaps, wherein two of the foldable flaps are oriented substantially perpendicular to each other, such that the display assembly may be oriented in four orientations on a surface, the orientation on the surface being dependent upon which of the foldable flaps are folded outward from the panel towards the surface.

11. The display assembly of claim 10, wherein the substantially flat sheet of material is a sheet of photographic paper in a size selected from 3 inches by 5 inches, 4 inches by 6 inches, 4 inches by 8 inches, 5 inches by 7 inches, 5 inches by 8 inches, and 8 inches by 10 inches.

* * * * *

UNITED STATES PATENT AND TRADEMARK OFFICE

CERTIFICATE OF CORRECTION

PATENT NO. : 8,074,385 B2
APPLICATION NO. : 12/911953
DATED : December 13, 2011
INVENTOR(S) : Paul F. Wagner It is certified that error appears in the above-identified patent and that said Letters Patent is hereby corrected as shown below:

Title Page, Item (75) Inventor, "Paul A. Wagner" should read -- Paul F. Wagner --.

Signed and Sealed this
Twenty-eighth Day of February, 2012

David J. Kappos

David J. Kappos
*Director of the United States Patent and Trademark Office*